United States Patent [19]

Bouton

[11] Patent Number: 5,076,611

[45] Date of Patent: Dec. 31, 1991

[54] SINGLE SHEET BOOK AND METHOD OF FORMING THE SAME

[75] Inventor: Jim Bouton, Teaneck, N.J.

[73] Assignee: The Jim Bouton Corporation, Teaneck, N.J.

[21] Appl. No.: 510,326

[22] Filed: Apr. 16, 1990

[51] Int. Cl.[5] ..... B42D 1/00

[52] U.S. Cl. ..... 281/3.1; 281/23; 283/63.1

[58] Field of Search ..... 281/2, 3.1, 5, 15.1, 281/16, 18, 19, 23, 51; 283/34, 63.1

[56] References Cited

U.S. PATENT DOCUMENTS

| | | | |
|---|---|---|---|
| 1,531,065 | 3/1925 | Boyer | 283/34 |
| 3,713,673 | 1/1973 | Katz | 281/3.1 |
| 3,920,267 | 11/1975 | Lyon, Jr. | 281/18 |
| 4,113,912 | 9/1978 | Okita . | |
| 4,270,773 | 6/1981 | Gaetano | 283/34 |
| 4,340,482 | 7/1982 | Sternberg . | |
| 4,538,833 | 9/1985 | Trikilis | 281/15.1 |
| 4,583,763 | 4/1986 | Shacklett, Jr. | 281/5 |

*Primary Examiner*—Frank T. Yost
*Assistant Examiner*—Hwei-Siu Payer
*Attorney, Agent, or Firm*—Blum Kaplan

[57] ABSTRACT

A small book having a cover and pages therein formed from a single sheet and method of making the book are provided. A single substantially rectangular sheet is divided into a plurality of printed panels integrally formed together. The panels are folded upon each other to form the cover and pages. Each of the panels forms the pages and cover and has printed thereon thematic information so that a series of small collectable books are created.

9 Claims, 3 Drawing Sheets

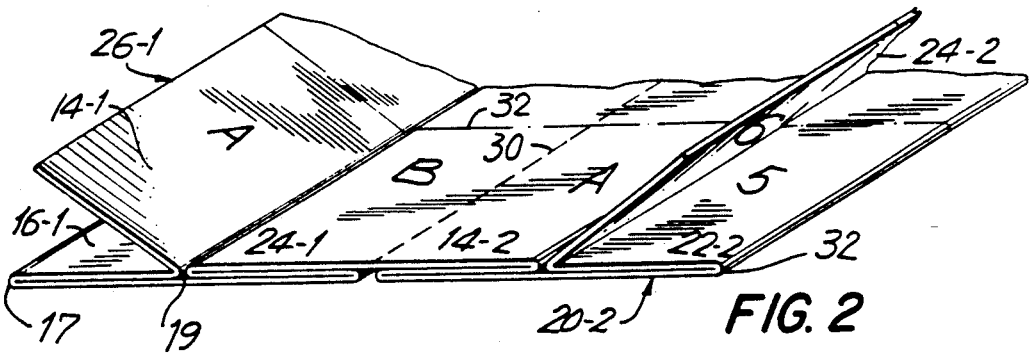
FIG. 2
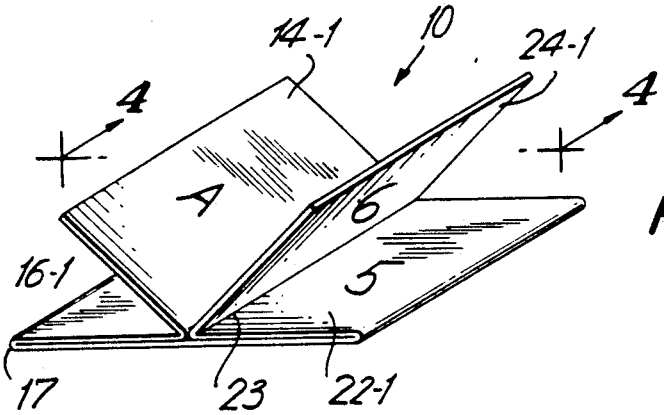
FIG. 3
FIG. 4
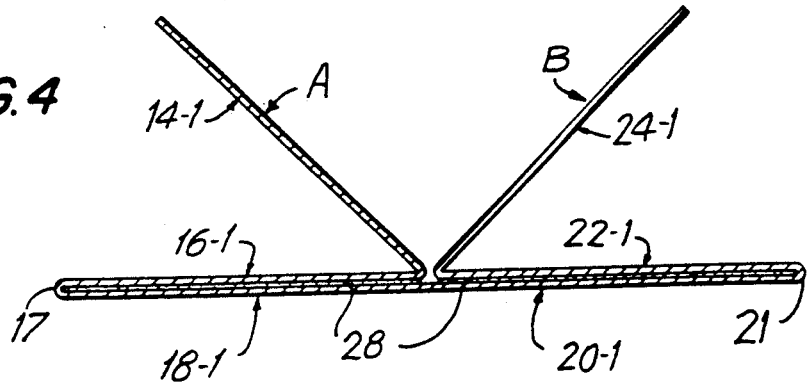
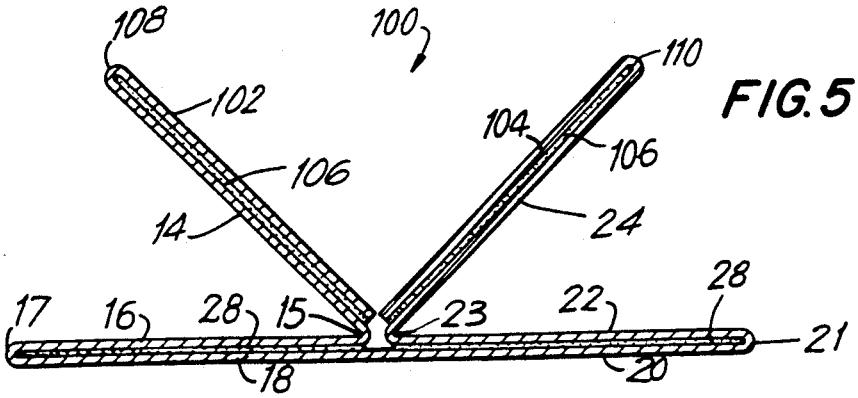
FIG. 5

SINGLE SHEET BOOK AND METHOD OF FORMING THE SAME

BACKGROUND OF THE INVENTION

This invention relates to multi-paged books and, in particular, to books which do not require a plurality of individual non-connected sheets to be affixed to each other and are particularly suited to thematic collectable books and a method for forming the same. Conventional books, newspapers or magazines normally include individual sheets each of which are joined together by either stapling, thread or glue. These sheets are then bound within a separate cover to contain and protect the pages therein. Additionally, such prior art books require several steps of manufacture including the arranging of the individual pages in the proper sequence, binding each of the pages in proper sequence and fitting a separate cover onto those pages. Also, the distinct materials for the cover and the pages must be present at all times to make a complete book.

It is proposed to provide a book that will serve as a thematic collectable product having a cover and several pages. A book formed of a single sheet that is folded to provide the cover and the several pages is particularly suited for such a product and is desired.

SUMMARY OF THE INVENTION

Generally speaking, in accordance with the instant invention, a single sheet book is provided. The single sheet is substantially rectangular. The sheet is divided along fold lines into a plurality of printed panels integrally formed together. The panels are folded upon each other along the fold lines so that a cover and interior pages are defined thereby.

In an exemplary embodiment, a single sheet book is dimensioned to be the size of a sports trading card and a series of books, all of which contain distinct information about different players, teams or other games, provides a collectable series of thematic books.

Accordingly, it is an object of the present invention to provide an improved book and method of forming the same.

Another object of the invention is to provide a book having a cover and pages therein all formed of a single sheet.

Still another object of the invention is to provide a small thematic collectable book formed from a single sheet of paper.

Still other objects and advantages of the invention will in part be obvious and will in part be apparent from the specification.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a perspective view of the printed sheet of FIG. 1 being formed into a plurality of books in accordance with the invention;

FIG. 3 is a perspective view of a single sheet book constructed in accordance with the invention;

FIG. 4 is a sectional view taken along lines 4—4 of FIG. 3;

FIG. 5 is a sectional view of a second embodiment of a single sheet book constructed in accordance with the invention;

DETAILED DESCRIPTION OF THE PREFERRED EMBODIMENTS

Reference is first made to FIGS. 1–4, wherein a single sheet book, generally indicated at 10, constructed in accordance with a preferred embodiment of the instant invention is depicted. In an exemplary embodiment, each book generally indicated at 10, is formed by a rectangular sheet 12 of 7 point white Coated 2S bristol cover paper stock, which is formed as a plurality of printed panels as depicted in FIGS. 3 and 4. The paper stock can have a thickness of 9 points or less to obtain the objectives of the instant invention.

Figure 1:
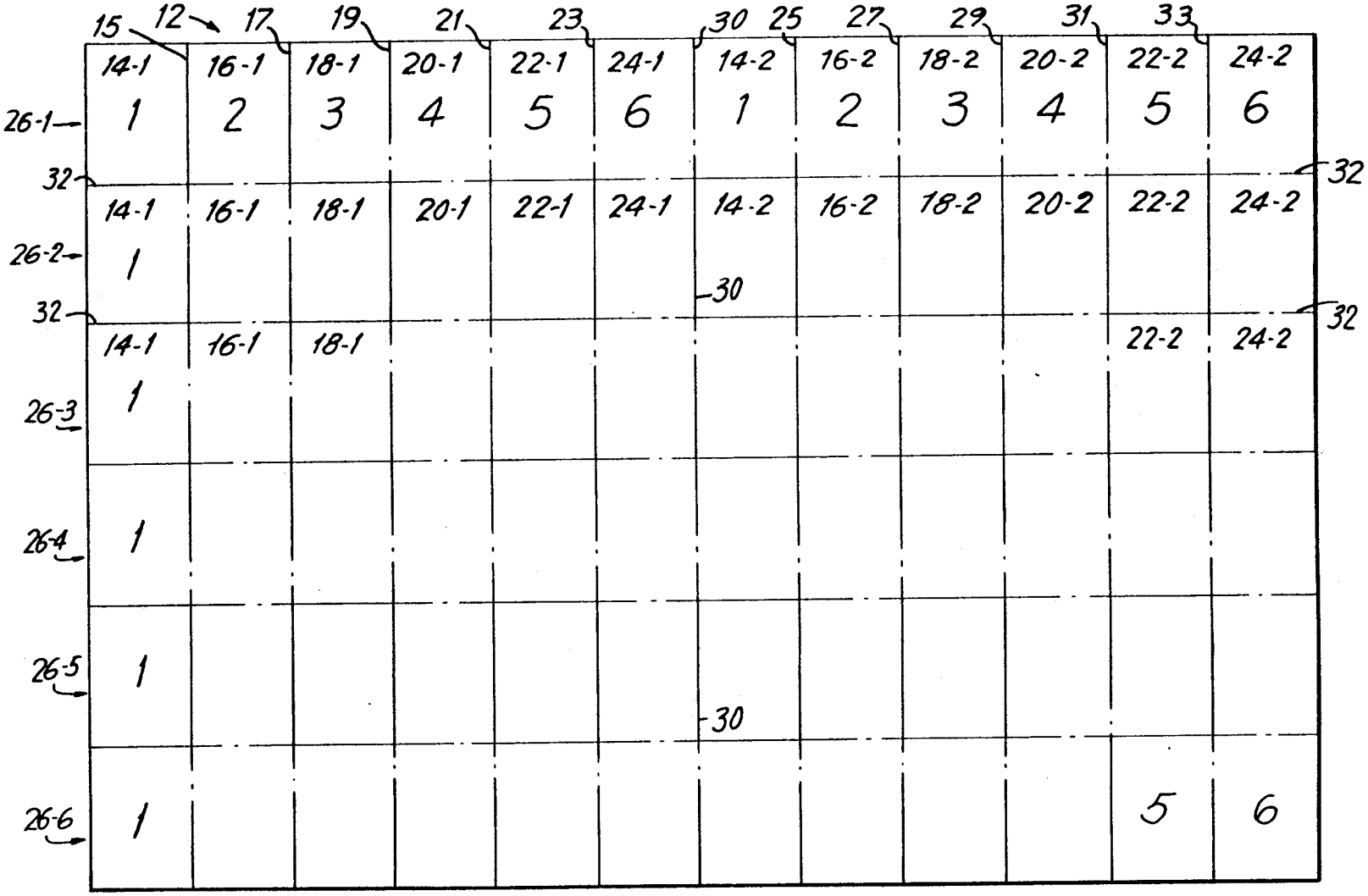
FIG. 1 is a top plan view of a printed sheet to be formed into a plurality of books prior to separation and folding and constructed in accordance with the instant invention.

Referring to FIG. 1, an elongated sheet 12 has across the width of the front surface thereof an array of printed panels 14-1, 14-2, 16-1 and 16-2, 18-1 and 18-2, 20-1 and 20-2, 22-1 and 22-2, and 24-1 and 24-2 each of which contains distinct printed information representing information on a page or a cover. Each panel having the identical information thereon, such as panels 14-1 and 14-2, is identified by a number printed thereon. By way of example, e.g., panels 14-1 and 14-2 are identified by the panel number 1 in FIG. 1. As will be explained below, each book to be formed from sheet 12 includes printed panels 1 through 6.

Each printed panel 14-1, 14-2 through 24-1, 24-2 is defined by fold lines 15, 17, 19, 21, 23, 25, 27, 29, 31 and 33 and by cut lines 32, which cut lines are transverse to the fold lines. Additionally, a cut line 30 separates a first array of panels 14-1 through 24-1 which will define a first book from a second array of panels 14-2 through 24-2 which panels will define a second book. On the rear surface of sheet 12 are printed panels lettered A and B, which panels are on the back surfaces of panels 14-1 and 14-2, respectively, and 24-1 and 24-2, respectively.

In order to print sheet 12 to form twelve books, six rows 26-1 through 26-6 of printed panels, including panels 14-1, 14-2 . . . through 24-1 and 24-2 are printed on the front surface. As explained above, printed panels A and B are printed on the back surface of panels 14-1 and 14-2, respectively, and 24-1 and 24-2, respectively, in each row 26-1 through 26-6.

After printing on both surfaces, sheet 12 is scored along each fold line 15, 17, 19, 21, 23, 25, 27, 29, 31 and 33 to permit folding along these lines. Additionally, sheet 12 is perforated along longitudinal cut lines 30 and transverse cut lines 32. As seen from FIG. 1, each panel 14-1 and 14-2 through 24-2 contains information printed on the front surface. As is described below, panels 14-1 and 14-2 and 24-1 and 24-2 will form the inner pages of book 10 and therefore have information printed on the front surface and information (A or B) printed on the back surfaces thereof. Panels with the prefix 16, 18, 20 and 22 are only printed on the front surfaces.

The method of forming books from sheet 12 is as follows. First, an appropriate adhesive, such as glue, 28 (FIGS. 3 and 4) is applied to the back surface of panels having the prefix 16, 18, 20 and 22 either prior to or when sheets 12 are placed onto a folding machine.

As is more particularly illustrated in FIG. 2, initially sheet 12 is folded with the rear surface facing upwards along fold lines 21 and 23 and 25 and 27, so that panels 22-1 are folded into 24-1 and so that panel 16-2 is folded into 14-2. Next, panels 14-1 and 16-1 are folded along fold lines 17 and then 15 and panels 22-2 and 24-4 are folded along fold lines 31 and then 33, so that the panels are folded in the manner illustrated in FIG. 2. Because of the adhesive placed on the rear surfaces of panels having the prefix 16-1 and 18, 20 and 22, the panels of sheet 12 are glued together to define multiply attached books.

Next, the sheet folded and glued in the manner depicted in FIG. 2, is cut along transverse perforated cut lines 32 and along lengthwise perforated cut line 30. Upon cutting, twelve (12) separate folded books, of the type depicted in FIG. 3, are formed. As particularly illustrated in FIG. 3, the printed information represented by panel numbers 3 and 4 would appear on the cover of each book 10. The inside cover page formed by panel 16-1 would have the information represented by the number 2 showing while the next page would be formed by panel 14-1 having the information represented by the number 1 on one surface and other information represented by the letter. A is printed on the back surface. Similarly, the back cover page of book 10 would be represented by information represented by the number 5 printed on panel 22-1. Panel 24-1 includes the information represented by the number 6 and would form one surface and other information represented by the letter B would be printed on the opposite surface.

In an exemplary embodiment of of single sheet book 10, the information represented by numbers 1 through 6 and panels A and B printed on each panel contain words and pictures. Specifically, a miniature booklet similar in size to sports trading and having a width no greater than 3½" and a height no greater than 5" is contemplated. In a preferred embodiment, each book has the dimensions of 2½" by 3⅜" which is identical to a sports trading card. Sports information, such as the picture of a baseball player, is printed on the cover page (panel 3) and a second picture or cartoon or caricature of a particular player can be printed on the back page (panel 4). On the inside of the cover (panel 2) and the inside of the back page (panel 5) and in the outer pages (panels 1 and A and 6 and B) biographical information and pictures can be printed. By printing a series of different books, a collectable series of miniature books having a sports theme or other collectable theme is provided. Moreover, by creating books having the same size as trading cards, the book can be stored in albums and other devices there were made for collecting and storing traditional trading cards.

Reference is now made to FIG. 5 in which another configuration for a single sheet book, generally indicated as 100, constructed in accordance with a second embodiment of the invention is provided. Like numerals are utilized to indicate like structure in single sheet book 100, the primary difference between single sheet book 100 and single sheet book 10 being the addition of panels 102, 104. Each book can be formed with a rectangular shape consisting of eight panels 14, 16, 18, 20, 22, 24, 102 and 104. Each panel is printed on a sheet in the manner described above and each sheet would be scored to define fold lines as described above. Glue 28 and glue 106 are applied to the back portions of panels 14, 16, 18, 20, 22, 102 and 104 respectively. The rectangular sheet is then folded. Panel 102 is folded about a fold line 108 and is brought into engagement with panel 14 so that glue 106 is disposed therebetween to maintain panels 102 and 14 in contact. Similarly, a panel 104 is folded along a fold line 110 into engagement with panel 24 so that glue 106 secures panel 24 to panel 104. The inside pages of book 100 formed by panels 14, 102 and panels 24, 104 are now formed as two-ply pages providing additional stability and rigidity. Utilizing this embodiment, the sheet is printed on only one side prior to assembly.

Figure 6:
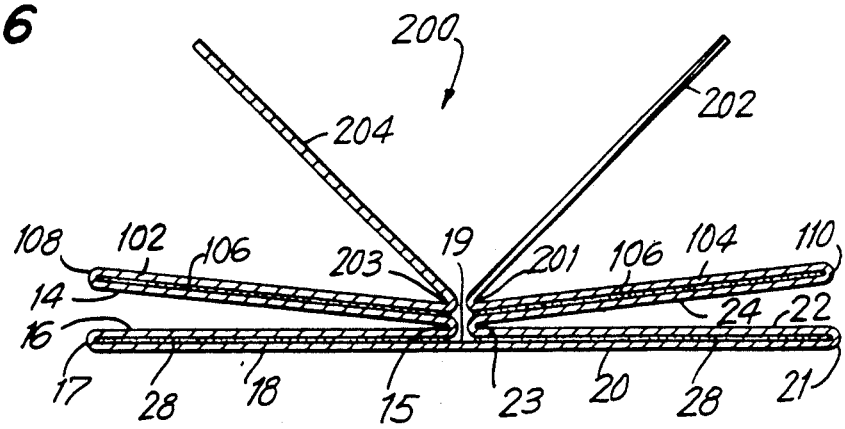
FIG. 6 is a sectional view of a third embodiment of a single sheet book constructed in accordance with the invention.

Reference is now made to FIG. 6 in which a single sheet book, generally indicated as 200, constructed in accordance with a third embodiment of the invention is provided. Like numerals are utilized to indicate like structures. The primary difference between single sheet book 200 and single sheet book 100 being the addition of two additional panels providing four additional pages.

Single sheet book 200 is formed from a rectangular sheet having 10 panels. A panel 204 is formed adjacent panel 102 and a panel 202 is formed adjacent panel 104. To form pages, panel 204 is folded along a fold line 203 into engagement with panel 102. Similarly, panel 202 is folded about fold line 201 into engagement with panel 104. Both panels 202 and 204 may be printed on both surfaces of each respective panel.

Figure 7:
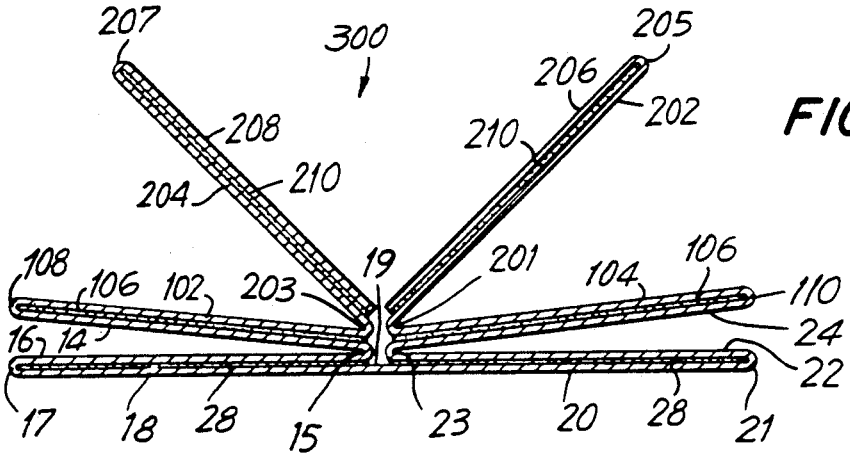
FIG. 7 is a fourth embodiment of a single sheet book constructed in accordance with the invention.

Reference is now made to FIG. 7 in which a single sheet book, generally indicated as 300, and constructed in accordance with a fourth embodiment of the invention is provided. Again, like numerals are utilized to indicate like structure. The primary difference between single sheet book 300 and single sheet book 200 being the addition of two panels utilized to form double ply inner pages and provide stability for the pages formed by panels 202 and 204 of single sheet book 200.

Single sheet book 300 is constructed from a rectangular sheet having 12 panels. The panels are formed as a single sheet yielding a plurality of books 300. Each book 300 is formed from a rectangular section having 12 panels. A panel 208 is formed adjacent panel 204 and a second panel 206 is formed adjacent panel 202. Glue 210 is applied to the back surface of panel 202 and the back surface of panel 204 during the gluing step. To form book 300, the rectangular sheet is folded as discussed above and panel 208 is folded substantially along a fold line 207 so as to be glued to panel 204. Similarly, a panel 206 is folded along a fold line 205 to be glued by glue 210 to panel 202. This results in a book 300 having a cover and 10 pages all of which are two-ply pages for added stability.

Figure 8:
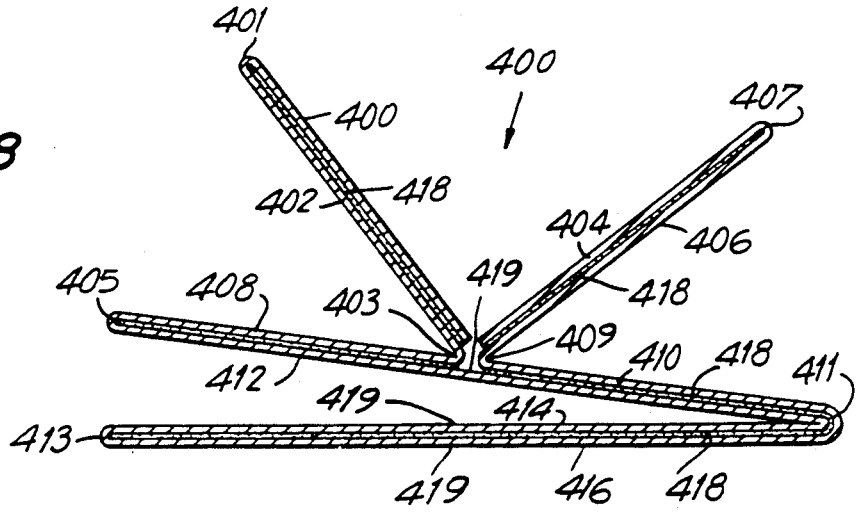
FIG. 8 is a sectional view of a single sheet book constructed in accordance with a fifth embodiment of the invention.

Reference is now made to FIG. 8 in which a single sheet book, constructed in accordance with a fifth embodiment of the invention is provided. Single sheet book 400 is similar to single book 300 with the exception that three of the panels are formed with substantially twice the width of the remaining panels to provide a four ply cover.

Book 400 is formed of a rectangular sheet having panels 400, 402, 404, 406, 408 and 410 formed of substantially the same size and panels 412, 414 and 416 formed of a size substantially greater than the remaining panels 400–410. Book 400 is formed as a plurality of books and printed and scored as described above. Panels 412, 414 and 416 are also scored at substantially the midpoint of each respective panel to form a fold line 419. The rear surfaces of each panel 400–416 is then applied with glue 418.

To form book 400, the glued book 400 is then folded. Panel 400 is folded along a fold line 401 into engagement with panel 402 so that panels 400 and 402 are affixed to each other by glue 418. Panel 402 is then folded about a fold line 403 into engagement with panel 408 to form a page. Panel 408 is folded along a fold line 405 into engagement with panel 412 to be affixed thereto by glue 418. Similarly, panel 404 is folded about a fold line 407 into egangement with panel 406 to be affixed thereto by glue 418. Panel 406 is folded about a fold line 409 into engagement with panel 410 to form a free moving page. Panel 410 is affixed to panel 412 by glue 418. Panel 410 is also folded about a fold line 411. Panel 414 is folded about a fold line 413 into contact with panel 416 and is affixed thereto by glue 418 at one end and about fold line 411 to form a page at its other end. Panel 414 is glued to panel 416 to form a four ply cover. Panels 412, 414 and 416 are each folded about fold line 419.

By providing elongated panels 414 and 416, a four ply cover is provided for providing even greater protection for the book pages contained therein. Additionally, in this embodiment each of the pages is formed by a double ply structure providing stability and durability to each page.

Accordingly, the instant invention is characterized by a single sheet book that can be used for small books having several pages that have printed thereon thematic information that will make the books desirable as collectables. For example, printing a plurality of books, each book about different sports hero or team, or about different characters in a famous work of fiction, or about different personalities, will provide a small collectable series of easy to handle small books that are easy to manufacture and collect.

It will thus be seen that the objects as set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A book comprising a cover and pages therein, formed of a single sheet, said sheet being substantially rectangular and being divided into a plurality of at least six display panels, each of said panels being sequentially positioned adjacent no more than two respective panels, said panels being folded upon each other, a centerfold having a first panel adjacent thereto and a second panel adjacent said first panel, a third panel on the other side of said centerfold and adjacent said first panel, and a fourth panel adjacent said third panel, said second panel being folded upon said first panel and being adhesively secured thereto, and said fourth panel being folded upon and adhesively secured to said third panel to form said cover, the remaining panels defining the pages of the book.

2. The book of claim 1, wherein each panel has a first surface and a second surface and information is displayed on at least one surface of each panel.

3. The book of claim 2, wherein information is displayed on the first surface and second surface of at least one panel.

4. The book of claim 1, wherein the book has a width no greater than 3½ inches and height no greater than 5 inches.

5. A plurality of booklets each formed in the manner defined in claim 4, and each book having distinct print and pictorial information printed thereon about a common theme, at least one of said plurality of books containing print and pictorial information different from print and pictorial information of at least a second of said plurality of books so that a series of small books having respective independent aesthetic value are created.

6. The books of claim 5, wherein each book is 2½ inches by 3⅜ inches.

7. A miniature booklet comprising a cover and a plurality of pages therein, said pages and said cover of said booklet being formed of a single sheet having a plurality of folded panels; a centerfold having a first panel adjacent thereto and a second panel adjacent said first panel, a third panel on the other side of said centerfold and adjacent said first panel, and a fourth panel adjacent said third panel, said second panel being folded upon said first panel and being adhesively secured thereto, and said fourth panel being folded upon and adhesively secured to said third panel to form said cover, the remaining panels defining the pages of the book; said booklet having a width no greater than 3½ inches and height no greater than 5 inches, and printed information on said panels, said information including at least one of pictorial information and print information.

8. A miniature booklet, as claimed in claim 7, wherein each booklet is 2½ inches by 3⅜ inches.

9. A plurality of booklets of the type claimed in claim 7, each of said booklets having distinct print and pictorial information printed on each panel about a common theme, at least one of said plurality of booklets containing print and pictorial information different from print and pictorial information of at least a second of said plurality of booklets so that a series of small books having respective independent aesthetic value about a common theme are defined.

* * * * *